US006439218B1

(12) United States Patent
Hulett

(10) Patent No.: US 6,439,218 B1
(45) Date of Patent: Aug. 27, 2002

(54) CUTTING APPARATUS WITH A SUPPORTING TABLE

(75) Inventor: Scott M. Hulett, Duarte, CA (US)

(73) Assignee: MK Diamond Products, Inc., Torrance, CA (US)

( * ) Notice: Subject to any disclaimer, the term of this patent is extended or adjusted under 35 U.S.C. 154(b) by 0 days.

(21) Appl. No.: 09/585,672

(22) Filed: Jun. 1, 2000

(51) Int. Cl.[7] ..... B28D 1/04

(52) U.S. Cl. ..... 125/13.01; 125/13.03; 125/11.22; 83/168; 451/449

(58) Field of Search ..... 125/13.01, 13.03, 125/11.22; 83/171, 169, 168; 451/449, 450

(56) References Cited

U.S. PATENT DOCUMENTS

| | | | | |
|---|---|---|---|---|
| 2,241,142 A | | 5/1941 | Kvalheim | |
| 3,008,462 A | * | 11/1961 | Williams | 125/13.01 |
| 3,090,615 A | | 5/1963 | Macy | |
| 3,807,095 A | | 4/1974 | Harding et al. | |
| 3,844,269 A | | 10/1974 | Rater | |
| 4,896,647 A | * | 1/1990 | Valva et al. | 125/35 X |
| 4,940,038 A | | 7/1990 | O'Keefe | |
| 4,976,251 A | | 12/1990 | Smith | |
| 4,991,354 A | | 2/1991 | Schweickhardt | |
| 5,127,391 A | * | 7/1992 | O'Keefe | 125/13.01 |
| 5,398,458 A | | 3/1995 | Henriksen et al. | |
| 5,482,026 A | | 1/1996 | Russell | |
| 5,542,325 A | | 8/1996 | Bane, III | |
| 5,605,141 A | | 2/1997 | Bilotta | |
| 5,676,124 A | * | 10/1997 | Lee | 125/13.01 |
| 6,000,387 A | * | 12/1999 | Lee | 125/13.01 |
| 6,119,676 A | | 9/2000 | Greenland | |
| 6,276,990 B1 | | 8/2001 | Greenland | |

OTHER PUBLICATIONS

Nuova–battipav 2001 EX Price List.

Jolly Max S Electrical Tile Cutter with Sliding Carriage, Nuova Battipav, Sep. 2000.

* cited by examiner

*Primary Examiner*—Joseph J. Hail, III
*Assistant Examiner*—Anthony Ojini

(57) ABSTRACT

An apparatus for cutting objects includes a pan, a table and an arm which lies secured to the table and extends outwardly of a supporting surface of the table. The pan supports the table, and the arm supports a cutting assembly including a motor and a cutting element. Ceramic tiles as well as other objects slide over the supporting surface of the table to the cutting element that cuts them. A fence that lies releasably secured to the table guides the objects to the cutting blade and away from the cutting element.

25 Claims, 5 Drawing Sheets

FIG. 6
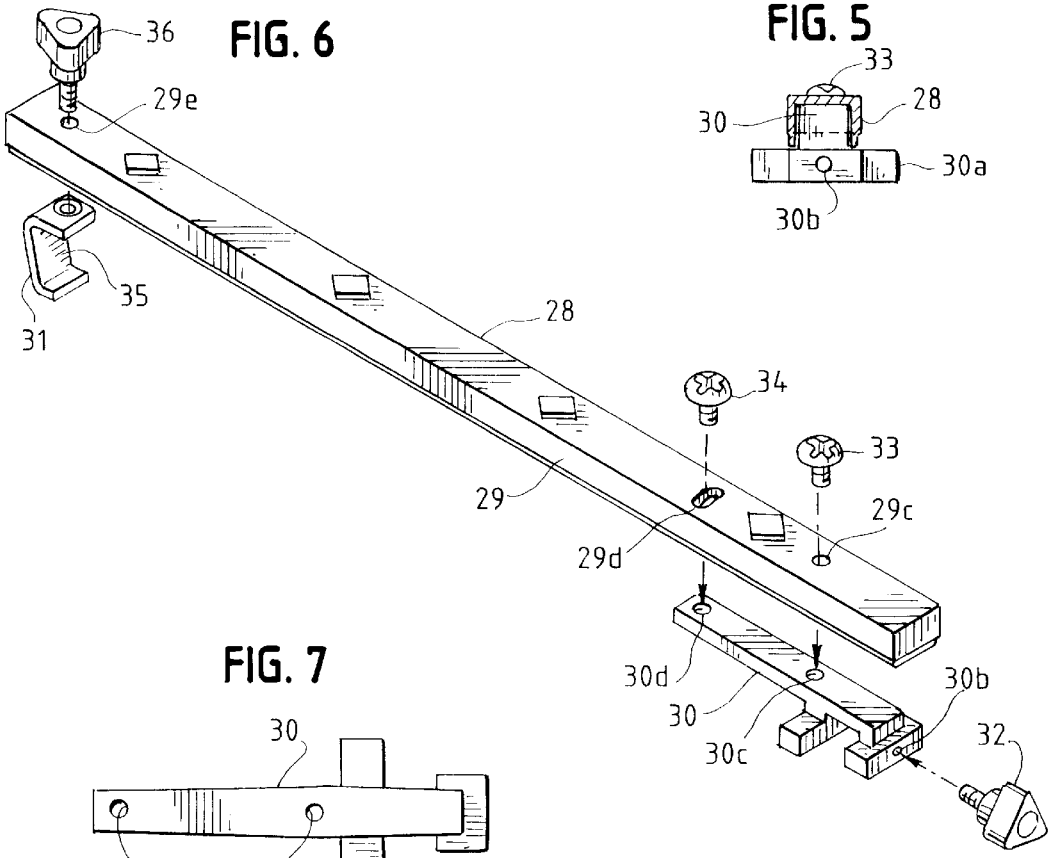
FIG. 5
FIG. 7
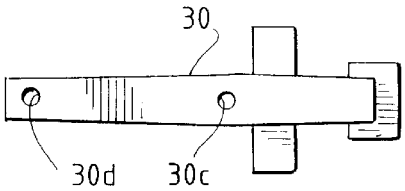
FIG. 10
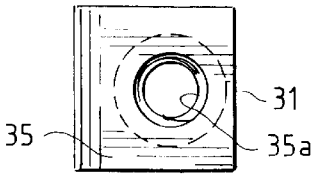
FIG. 8
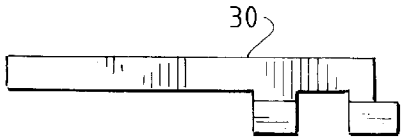
FIG. 11
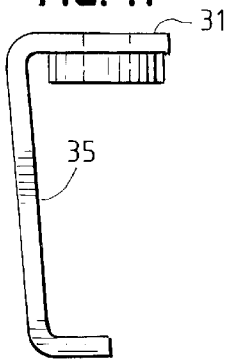
FIG. 9
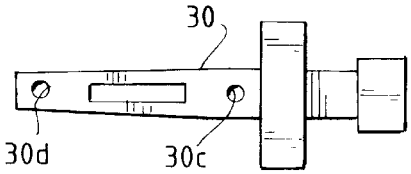

CUTTING APPARATUS WITH A SUPPORTING TABLE

BACKGROUND OF THE INVENTION

1. Field of the Invention

The present invention relates to a cutting apparatus, and more particularly to a tile saw that includes a rotary cutting element and a stationary table. Although the present invention finds particular utility in cutting ceramic tile or other similar objects, one may use it in a variety of applications.

2. Description of the Prior Art

The prior art includes a large number of tile saws, masonry saws and other such devices for cutting and shaping objects of different shapes, sizes and hardness. Some of those cutting implements are precision devices designed to make precise cuts at close tolerances. Others, e.g., devices used in the building industry, have constructions designed to resist the damaging effects of the elements and to facilitate portability.

The cutting apparatus of the present invention provides precision cutting while effectively resisting the elements and minimizing malfunctions that they may cause. It includes a table, a separate pan that supports the table, a cutting element disposed substantially above the supporting surface of the table, a motor that drives the cutting element, and a water pump that provides coolant for the cutting element. It can cut very hard objects such as ceramic tiles easily and precisely. It is a simple, lightweight and durable construction that facilitates portability, reduces the cost of manufacture and assembly, and provides consistent and reliable performance.

SUMMARY OF THE INVENTION

In accordance with one embodiment of this invention, a cutting apparatus includes a table, a motor, a rotatable cutting element driven by the motor, and an arm for supporting the motor and cutting element above the table. A pan supports the table and receives fluid used to cool the cutting element as it cuts an object. A pump assembly moves the fluid (e.g., water) from the pan to the cutting element. A detachable fence guides a tile or other object that the apparatus cuts.

The table is a rigid plate-like structure with a configuration that allows it to fit into the pan where shelf portions in the pan support the table a predetermined distance above its bottom. (Cooling fluid collects in the space between the bottom of the table and the bottom of the pan.) The table defines an elongate opening that receives edge portions of the cutting element as it rotates during operation. It also defines a plurality of openings throughout its body for the drainage of coolant and for the removal of cuttings from the table surface.

The arm lies secured at one of its end portions to the table; and at an opposite end portion, it supports the motor and cutting element above the table at a fixed, predetermined position. Thus, the cutting element and the table do not change positions relative to one another during operation. The arm also contains tubing for the coolant so that the tubing does not interfere with the cutting action.

The fence is a separate elongate structure that extends across the top of the table and includes a main body segment and attaching segments at opposite ends of the main body segment. The attaching segments allow a user to releasably secure the fence to the table at different locations and distance from the cutting element, on each side of the cutting element. At least one of the attaching segments also allows adjustment of the main body segment to vary the angle between an edge of an object and the line of cut made by the apparatus.

BRIEF DESCRIPTION OF THE DRAWINGS

For a more complete understanding of this invention, one should now refer to the embodiment illustrated in greater detail in the accompanying drawings and described below by way of an example of the invention. In the drawings:

FIG. 5 is a sectional view taken along line 5—5 in FIG. 3;

FIG. 6 is an exploded perspective view of the fence for the cutting apparatus of the present invention;

FIG. 7 is a top plan view of a first attaching segment of the fence shown in FIG. 6;

FIG. 8 is a side elevation view of the first attaching segment of FIG. 7;

FIG. 9 is a bottom view of the first attaching segment of FIG. 7;

FIG. 10 is a top plan view of a bracket used as a second attaching segment in the fence shown in FIG. 7;

FIG. 11 is a side elevation view of the bracket of FIG. 10;

While the following disclosure describes the invention in connection with one embodiment, one should understand that the invention is not limited to this embodiment. Furthermore, one should understand that the drawings are not to scale and that graphic symbols, diagrammatic representatives, and fragmentary views, in part, may illustrate the embodiment. In certain instances, the disclosure may not include details which are not necessary for an understanding of the present invention such as conventional details of fabrication and assembly.

DETAILED DESCRIPTION OF THE DRAWINGS

Figure 1:
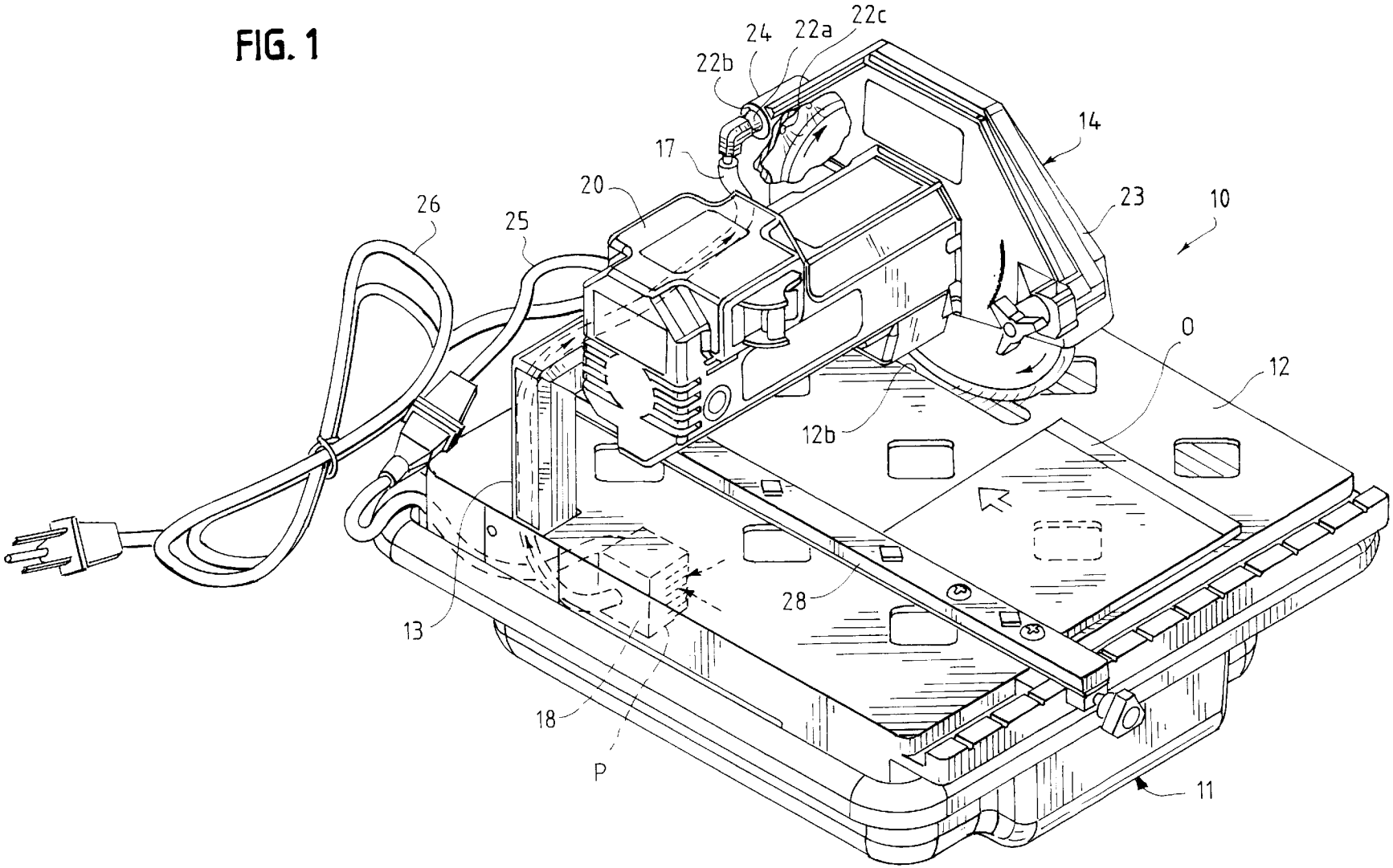
FIG. 1 is a perspective view of the apparatus of the present invention.
Figure 2:
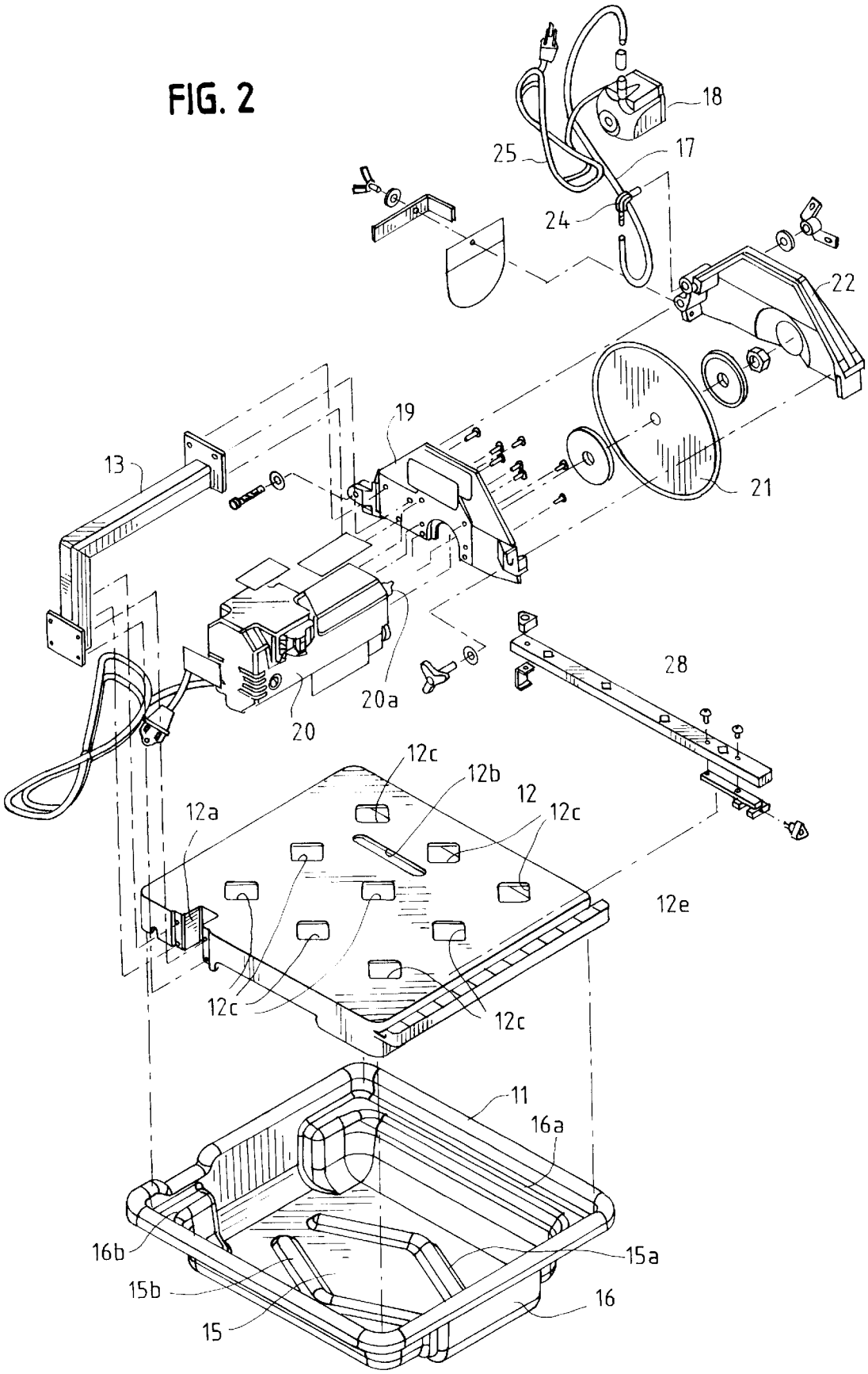
FIG. 2 is an exploded perspective view of the apparatus of the present invention.

Turning now to the drawings and referring specifically to FIGS. 1 and 2, the cutting apparatus of the present invention 10 generally includes a pan 11; a table 12 disposed on the pan 11; a support arm 13 secured to the table; a cutting assembly 14 secured to the support arm 13; and a pump assembly P that moves cooling fluid such as water from the pan 11 to the cutting assembly 14. The pan 11 and the table 12 serve as a base for the cutting assembly 13.

The pan 11 receives cuttings that drop from an object O that the apparatus 10 cuts. It also receives run-off fluid (e.g., water) that flows off the cutting assembly 14 and the object O during the cutting operation. The pan 11 is made out of hard plastic or any other suitable, light-weight material of high strength and rigidity. It is a shallow receptacle with a generally rectangular configuration. It has a flat bottom 15 that defines ribs 15*a* and 15*b* and sidewalls 16 surrounding the flat bottom 15 and defining a first shelf 16*a* and a second shelf 16*b*. The ribs 15*a* and 15*b* provide structural integrity, i.e., rigidity, to the flat bottom 15 while the shelves 16*a* and 16*b* serve as footings or receiving pads for the table 12 that the pan supports.

Figure 4:
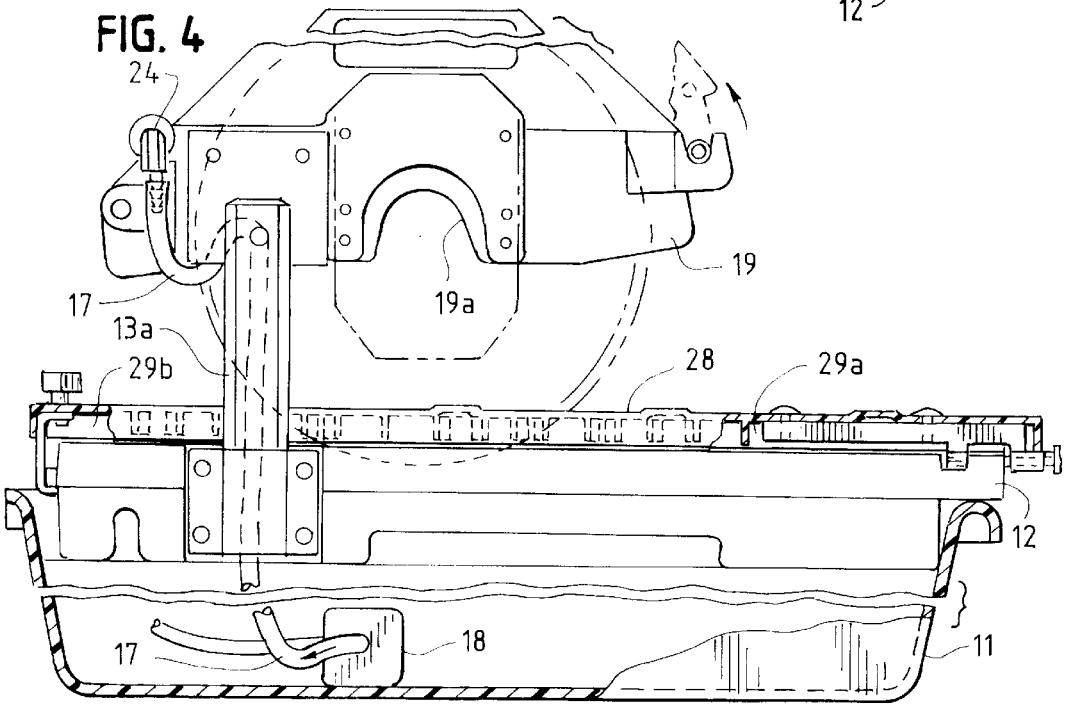
FIG. 4 is a side elevation view of the apparatus of the present invention with cutaway portions.

The table 12 also has a generally rectangular configuration similar to that of the top opening of the pan 11. The size of the table 12 is small enough to allow the table to fit into the top opening of the pan 11 as shown in FIGS. 1 and 4, but big enough to engage the first and second shelves, 16*a* and 16*b*. During operation of the apparatus 10, the table 12 remains stationary and provides a supporting and sliding surface for tiles or other objects O. The table 12 is made of aluminum or any other lightweight material of high strength and rigidity while the support arm 13 and cutting assembly 14 are made of steel or other suitable materials.

Figure 3:
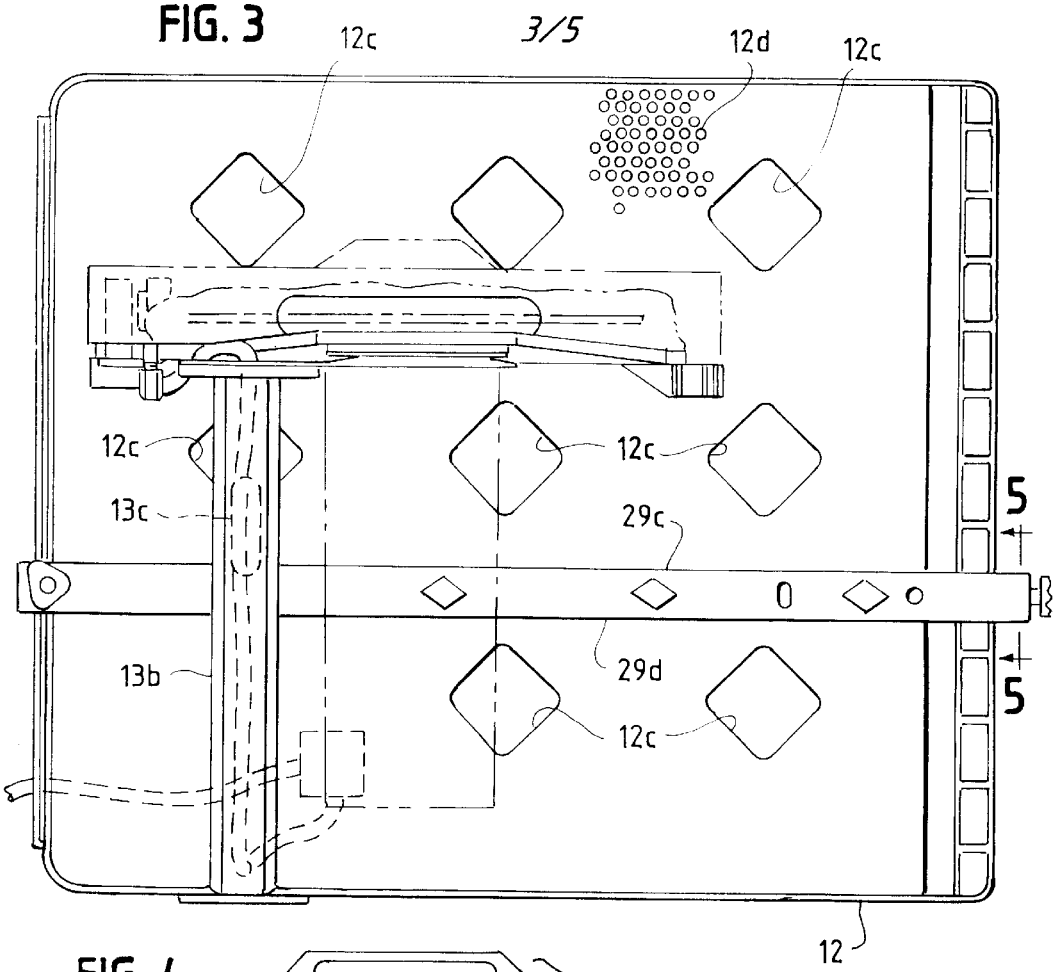
FIG. 3 is a top plan view of the table of the apparatus in FIG. 1.

The support arm 13 is a hollow member that supports the cutting assembly 14 and guides tubing 17 of the pump assembly P from a pump 18 disposed in the bottom of the pan 11 to the cutting assembly 14. (See FIGS. 3 and 4) The arm 13 has a generally vertical portion 13*a* and a generally horizontal portion 13*b*. It lies fixedly mounted (as with bolts) at the bottom end of its vertical portion 13*a* to the table 12 at an edge portion of the table 12 within the groove 12*a*; and it supports a mounting plate 19 for the cutting assembly 14.

The mounting plate 19 lies bolted or otherwise secured to the distal, free end of the horizontal portion 13*b* of the arm 13. In that position, it supports a motor 20 that drives a cutting element 21 (e.g., a diamond encrusted cutting disk) of the cutting assembly 14 of the apparatus 10. The motor's rotatable axle 20*a* extends through a groove 19*a* in the mounting plate 19 to support the cutting element 21 which lies between the plate 19 and a cover 22.

The cover 22 and the mounting plate 19 cooperate to form a shell or guard 23 for the cutting assembly 14, a guard that extends around the top portion of the cutting disk 21. This guard 23 protects an operator from the cutting disk and the debris that the disk may launch at the operator. The guard 23 also facilitates the application of cooling fluid onto the cutting disk 21.

The cover 22 of the guard 23 defines a bore 22*a* and an inlet 22*b* and two outlets 22*c* for the bore 22*a*. (Although the guard 23 includes two discharge outlets 22*c*, alternatively, it may include more than two outlets or just one outlet.) The bore 22*a* serves as a manifold; and the inlet 22*b* is larger than each of the two outlets 22*c*. Thus, the water or other cooling liquid discharges at a greater velocity than the velocity with which it enters the bore 22*a*.

A fitting 24 connects the tubing 17 of the pump assembly P to the bore 22*a*. This tubing 17 extends through the bottom of the vertical portion 13*a* of the arm 13, along the hollow centers of the vertical portion 13*a* and the horizontal portion 13*b* and out of the arm 13 through an opening 13*c* in the horizontal portion 13*b*. An insulated electrical conductor 25 operably connects the pump 18 to the motor 20; and a second insulated conductor 26 connects the motor 20 to a power source (e.g., an AC outlet). These connections allow the pump to operate only during operation of the motor 20.

Figure 15:
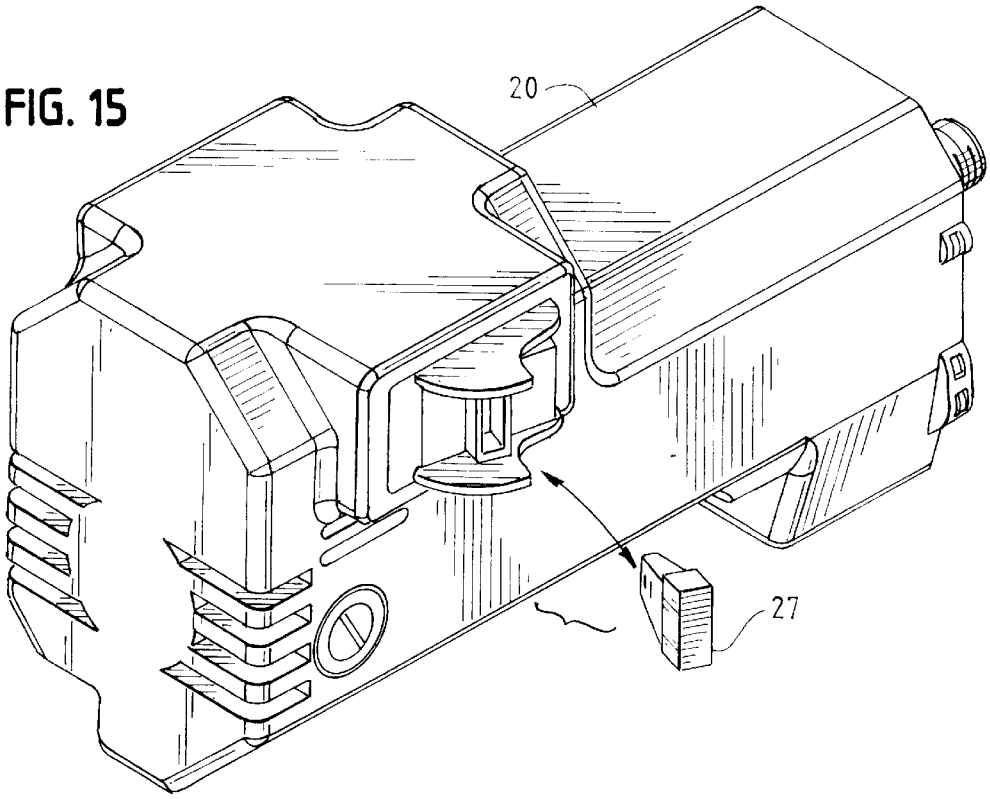
FIG. 15 is a perspective view of the motor of the cutting apparatus of the present invention.

To operate the cutting apparatus 10, one must first insert a key 27 (See FIG. 15) into the motor 20 and activate the motor. The cutting disk 21 then begins to rotate and the pump 18 begins to operate, directing water through the tubing 17, into the guard 23 and onto the disk 21. As the disk 21 rotates, its bottom edge portion extends into a slot 12*b* in the table 12. This slot 12*b* allows the cutting disk to cleanly cut through the tile or other object O. Openings 12*c* in the table 12 allow easy drainage of the cooling fluid from the top surface of the table to the pan 11, as well as the removal of cuttings from the table surface.

The table 12 further includes a pattern of dimples 12*d* on its top surface. (See FIGS. 12–14) These dimples 12*d* minimize the area of contact between the table 12 and the object O (e.g., tile) that the apparatus 10 cuts. They cooperate with the coolant (e.g., water) which discharges from the cutting disc 21 and flows onto the table surface before it flows through the opening 12*c* and into the pan 1. The coolant acts as a lubricant to further facilitate movement of the object O over the surface of the table 12.

Figure 12:
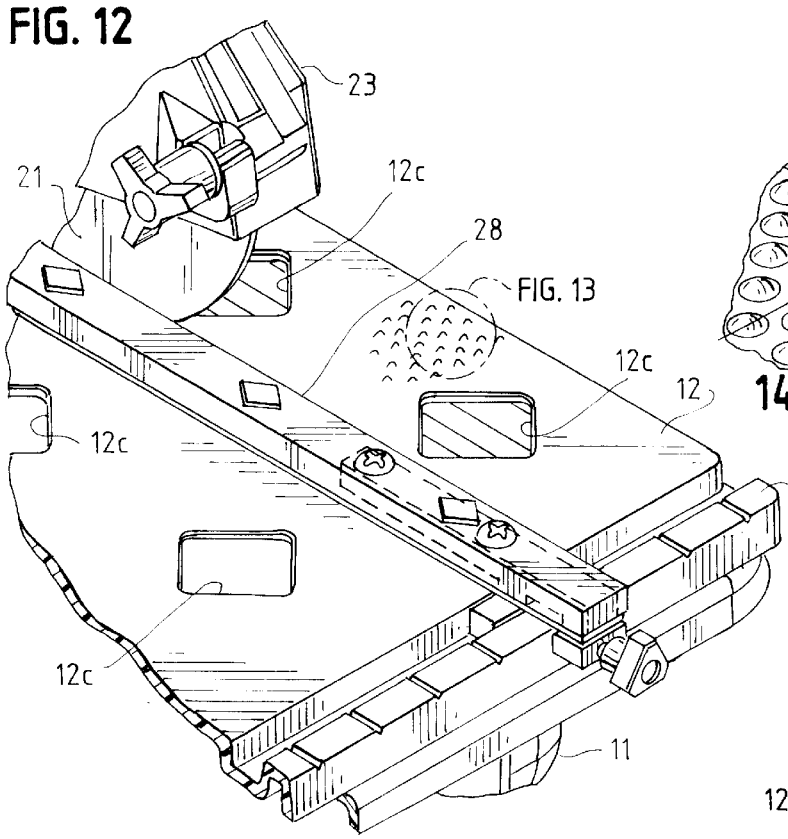
FIG. 12 is a partial perspective view of the table and fence of the cutting apparatus.
Figure 13:
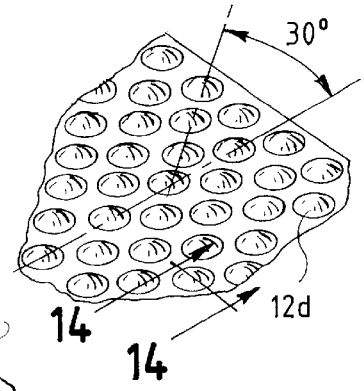
FIG. 13 is an enlarged perspective view of the surface of the table in the apparatus of the present invention.
Figure 14:
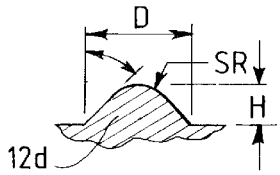
FIG. 14 is an enlarged cross-sectional view of one of the dimples on the surface of the table of the present invention.

In the specific example further described below, an apparatus 10 included a table with rows of dimples 12*d* as shown in FIGS. 12 and 13. The dimples were 1/16 inches in height and 1/16 in radius, and the spacing between adjacent dimples was 1/16 inches.

A fence 28 guides the object O along a desired path so that the cutting disk 21 may cut it (See FIGS. 1–12). This fence 28 is a separate elongate structure, and it includes an elongate main body segment 29, a first attaching segment 30 at one end, and a second attaching segment 31 at an opposite end. The main body segment 29 includes cavities 29*a* and 29*b* for receiving portions of the attaching segments 30 and 31, respectively. (See FIG. 4) It also includes two straight faces 29*c* and 29*d* disposed longitudinally along its length.

The first attaching segment 30 defines a groove 30*a* for receiving a rail portion 12*e* of the table 12. (The rail portion 12*e* lies at a 90° angle to the cutting disc 21.) A finger screw 32 extends into a threaded bore 30*b* and allows one to releasably secure the segment 30 to the rail portion 12*e*. Two set screws 33 and 34 secure the segment 30 to the main body segment 29. The first set screw 33 extends through an opening 29*c* in the segment 29 and into a bore 30*c* in the segment 30; and it serves as a pivot between the segment 29 and the segment 30.

The second set screw 34 extends through a slot 29*d* in the segment 29 and into an opening 30*d* in the segment 30. The slot 29*d*, the cavity 29*a* in the main body segment 29, and the shape of the segment 30 allow lateral adjustment of the segment 30 with respect to the segment 29. (The width of the segment 30 at the end that defines the opening 30*d* is smaller than the width of the cavity 29*a* that receives it.) This adjustment allows an operator to vary the path of travel of the object O as it slides over the table 12.

The second attaching segment 31 includes a bracket 35 that normally extends around an edge portion of the table 12. A finger screw 36 extends through an opening 29*e* and a threaded opening 35*a* in the bracket 35 to engage the table edge portion and releasably secure the main body segment 29 to the table 12.

By way of a specific example, an apparatus 10 was constructed with a pan 11 that holds two gallons of water, the optimum amount of fluid for cutting 150 pieces of 12×12 inch tile. The motor 20 was positioned by the arm 13 to lie within the periphery of the pan 11 and to allow the disc 21 to cut 6 inches of tile. The disc 21 extended approximately ¼ inches below the surface of the table 12.

While the above description and the drawings disclose and illustrate one embodiment, one should understand, of course, that the invention is not limited to this embodiment.

Those skilled in the art to which the invention pertains may make other modifications and other embodiments employing the principles of this invention, particularly upon considering the foregoing teachings. For example, the apparatus 10 may include one base rather than the separate table and pan arrangement of the illustrated embodiment.

Therefore, by the appended claims, the applicant intends to cover any modifications and other embodiments as incorporate those features which constitute the essential features of this invention.

What is claimed is:

1. A cutting apparatus for cutting tile, masonry or like objects, said apparatus comprising:

a pan including a bottom portion and sidewall portions, said sidewall portions defining a top opening and a shelf disposed proximate the top opening;

a stationary table normally resting on the shelf and substantially closing the top opening of the pan, said table being a flat, plate-like structure and defining a supporting surface over which the objects slide;

a supporting arm secured directly to the table and extending outwardly of the supporting surface; and a motor and a cutting element supported by the supporting arm substantially above the table.

2. The apparatus of claim 1, further comprising a pump assembly with a pump and tube for moving a liquid from the pan and onto the cutting element.

3. The apparatus of claim 1, further comprising a guard member extending over a top portion of the cutting element.

4. The apparatus of claim 3, wherein the guard member defines a bore and inlet and outlet openings for the bore for directing cooling fluid to the cutting element.

5. The apparatus of claim 1, wherein the supporting arm is a hollow tube with a vertical portion and a horizontal portion.

6. The apparatus of claim 1, further comprising a detachable fence for guiding objects over the supporting surface of the table.

7. The apparatus of claim 1, wherein the table defines a slot for receiving edge portions of the cutting element.

8. The apparatus of claim 1, wherein the table and pan are separate and generally rectangular.

9. The apparatus of claim 1, wherein the supporting arm is secured to an edge portion of the table.

10. A cutting apparatus for cutting tile, masonry or like objects, said apparatus comprising a pan including a bottom portion and sidewall portions, said sidewall portions defining a top opening and a shelf disposed proximate the top opening;

a stationary table normally resting on the shelf and substantially closing the top opening of the pan, said table being a flat, plate-like structure and defining a supporting surface over which the objects slide;

a supporting arm secured directly to the table and extending outwardly of the supporting surface;

a motor and a cutting element supported by the supporting arm substantially above the table;

a pump assembly with a pump and tube for moving a liquid from the pan and onto the cutting element; and a guard member extending over a top portion of the cutting element.

11. The apparatus of claim 10, wherein the supporting arm is a hollow tube with a vertical portion and a horizontal portion.

12. The apparatus of claim 10, further comprising a detachable fence for guiding objects over the supporting surface of the table.

13. The apparatus of claim 10, wherein the table defines a slot for receiving edge portions of the cutting element.

14. The apparatus of claim 10, wherein the table and pan are separate and generally rectangular.

15. The apparatus of claim 10, wherein the supporting arm is secured to an edge portion of the table.

16. The apparatus of claim 10, wherein the guard member defines a bore and inlet and outlet openings for the bore for directing cooling fluid to the cutting element.

17. A fence for a tile saw or other such cutting apparatus, said fence comprising: an elongate main body segment; and a first and separate attaching segment for releasably engaging a table of the cutting apparatus, said first attaching segment being attached to the main body segment; said main body segment and said first attaching segment being adjustable with respect to one another to vary the angle between one and the other and to allow variation in the positioning of the main body segment.

18. The fence of claim 17, further comprising a second attaching segment for releasably engaging the table, the first and second attaching segments being disposed on opposite sides of the main body segment.

19. A fence for a tile saw or other such cutting apparatus, said fence comprising: an elongate main body segment that defines a face for engaging objects and guiding them along a path of travel; a first and separate attaching segment for releasably engaging a table of the cutting apparatus, said first attaching segment being pivotally secured to the main body segment at a first predetermined point on the first attaching segment, said first attaching segment being secured to the main body segmented at a second predetermined point on the first attaching segment, said second point being disposed a spaced distance from the first point, said second point being adjustable relative to the main body segment to vary the angle between one and the other and to allow variation in the positioning of the main body segment.

20. The fence of claim 19, further comprising a second attaching segment for releasably engaging the table, the first and second attaching segments being disposed on opposite sides of the main body segment.

21. A cutting apparatus with a motor, a cutting element, a pan and a stationary table normally disposed over the pan, the table defining a supporting surface, the supporting surface including flat portions and a plurality of raised dimple portions, the table being a one-piece unit.

22. The apparatus of claim 21, wherein the pan is a separate member and includes a bottom portion and sidewall portions, the sidewall portions defining a top opening and a shelf disposed proximate the top opening, the table normally resting o[008e] the shelf.

23. The apparatus of claim 21, wherein the dimple portions are spaced a predetermined distance apart in rows that are spaced a predetermined distance apart.

24. The apparatus of claim 21 further comprising a supporting arm secured to the table, the motor and the cutting element being supported by the supporting arm substantially above the table.

25. The apparatus of claim 21, wherein the table defines a plurality of openings.

* * * * *